US011255643B2

(12) United States Patent
Ang et al.

(10) Patent No.: US 11,255,643 B2
(45) Date of Patent: Feb. 22, 2022

(54) SYSTEM FOR COUNTERING AN UNMANNED AERIAL VEHICLE (UAV)

(71) Applicant: ADVANCED MATERIAL ENGINEERING PTE LTD, Singapore (SG)

(72) Inventors: Wen Jun Edwin Ang, Singapore (SG); Yong Peng Tan, Singapore (SG); Juan Kiat Quek, Singapore (SG); Ce Yu Poo, Singapore (SG); Yuen Hoong Benedict Woo, Singapore (SG); Cheng Hok Aw, Singapore (SG)

( * ) Notice: Subject to any disclaimer, the term of this patent is extended or adjusted under 35 U.S.C. 154(b) by 0 days.

(21) Appl. No.: 16/967,142

(22) PCT Filed: Jan. 31, 2019

(86) PCT No.: PCT/SG2019/050056
§ 371 (c)(1),
(2) Date: Aug. 4, 2020

(87) PCT Pub. No.: WO2019/151950
PCT Pub. Date: Aug. 8, 2019

(65) Prior Publication Data

US 2020/0363165 A1 Nov. 19, 2020

(30) Foreign Application Priority Data

Feb. 5, 2018 (SG) ..... 10201800999Q

(51) Int. Cl.
*F41H 11/02* (2006.01)
*F41H 13/00* (2006.01)
*F42B 12/58* (2006.01)

(52) U.S. Cl.
CPC ..... *F41H 11/02* (2013.01); *F41H 13/0006* (2013.01); *F42B 12/58* (2013.01)

(58) Field of Classification Search
CPC ..... F41H 11/02; F41H 13/0006; F42B 12/58
(Continued)

(56) References Cited

U.S. PATENT DOCUMENTS 2,372,383 A 3/1945 Lee
5,005,483 A 4/1991 Deffayet
(Continued)

FOREIGN PATENT DOCUMENTS

EP 3109586 A1 12/2016
FR 3029279 A3 6/2016

OTHER PUBLICATIONS

ISR; Intellectual Property Office of Singapore; dated May 9, 2019.

*Primary Examiner* — Samir Abdosh
(74) *Attorney, Agent, or Firm* — Patshegen IP LLC; Moshe Pinchas

(57) ABSTRACT

The present invention describes an air-burst projectile (100) and a system (200) for deploying the airburst projectile to counter an unmanned aerial vehicle (UAV) 10. Each airburst projectile includes one or more spinners (140, 140*a*-140*d*); each spinner has a sleeve or a tube (146), a number of radial partition plates (148, 148*a*-148*d*) extending from the sleeve/tube and an annular rear plate (144) connected to the sleeve. Adjacent partition plates thus form a compartment (150). Disposed in each compartment is a streamer or streamers (170,170*a*,170*b*), which are formed in a coiled-up state. When the airburst projectile is deployed into a flight path of a target UAV, the spinners (140, 140*a*-140*d*) are ejected and the streamers (170,170*a*,170*b*) are dispersed in the flight path to create a streamer cloud, so that a streamer may entangle with propellers of the UAV and bring down the UAV, or as a warning or fence marking shot.

13 Claims, 10 Drawing Sheets

(58) Field of Classification Search
USPC ..... 89/1.11
See application file for complete search history.

(56) References Cited

U.S. PATENT DOCUMENTS

| | | | | |
|---|---|---|---|---|
| 10,197,365 | B1 * | 2/2019 | Blyskal | F42B 12/625 |
| 10,703,451 | B1 * | 7/2020 | Adams | F42B 15/08 |
| 10,724,831 | B1 * | 7/2020 | Walker | F41H 11/02 |
| 2017/0261292 | A1 * | 9/2017 | Armstrong | F42B 12/56 |
| 2018/0162529 | A1 * | 6/2018 | Klein | B64D 1/02 |
| 2018/0292184 | A1 * | 10/2018 | Down | F42B 12/36 |
| 2019/0063881 | A1 * | 2/2019 | Abramov | G05D 1/104 |
| 2019/0088156 | A1 * | 3/2019 | Choi | F41G 7/2293 |
| 2019/0285388 | A1 * | 9/2019 | Klar | G05D 1/0094 |
| 2020/0108926 | A1 * | 4/2020 | Smith | F41H 11/02 |
| 2020/0130835 | A1 * | 4/2020 | Lebaron | F41A 19/59 |
| 2020/0363165 | A1 * | 11/2020 | Ang | F42B 12/58 |

* cited by examiner

M4/M203

SAR21/40GL

SCAR MK16/EGLM

SCAR MK13

SA 80/ UGL

SYSTEM FOR COUNTERING AN UNMANNED AERIAL VEHICLE (UAV)

FIELD OF INVENTION

The present invention relates to a system for countering or neutralising an unmanned aerial vehicle (UAV) or drone that is driven by propellers. In particular, the invention relates to a programmable airburst projectile that is fired to discharge streamers near a UAV, to disable or bring down the UAV.

BACKGROUND

Mini-UAV or drones driven by propellers are becoming a common sight; these are deployed commercially (such as, for aerial photography or delivery of a product), for law enforcement (such as, reconnaissance, policing, combat, etc.) or as hobby crafts. FIG. 1A illustrates components of a typical drone.

Conventional counter drone measures to intercept and neutralise any undesirable drones have their own limitations. For eg., US patent publication no. 20170237520 describes a portable directional jammer to disrupt navigation of a UAV, for eg. as seen in FIG. 1B. In another approach, one can use a conventional gun (such as, shot gun or an artillery gun) to shoot down a target drone, as seen in FIGS. 1C and 1D; these methods are rather dangerous to implement. It is also possible to bring down a target drone with a net (as seen in FIG. 1E) which system uses an attack drone, but the entire system can be complex and expensive to deploy; as an alternative, FIG. 1F shows a standalone net gun, which is used to deploy a net. In another approach, FIG. 1G shows a UAV defender which is used to jam a target UAV.

In another approach, U.S. Pat. No. 9,175,934, issued to Lockheed Martin Corp., describes an auto-injector countermeasure for non-destructive disabling and control of UAVs. The auto-injector device is mounted on an attack UAV and the countermeasure involves controlling the attack UAV to intercept a target UAV, firing the auto-injector, injecting a disabling substance into the target UAV, exerting control over the target UAV and navigating the target UAV to a location for retrieval.

In yet another eg., US patent publication no. 2016/0023760, by Insitu, Inc., describes a counter-UAV system, which involves an interceptor UAV launched toward a target UAV. The interceptor UAV can disable the target UAV by deploying a net to entangle the target UAV. The counter UAV system requires a ground based launch control, target acquisition, guidance and communication sub-systems, which make the system complex and expensive to deploy.

Despite the above advances, there is still a need to provide another system to bring down an undesirable UAV or drone; preferably, this system is simple to deploy, yet requires little re-training or capital expenses.

SUMMARY

The following presents a simplified summary to provide a basic understanding of the present invention. This summary is not an extensive overview of the invention, and is not intended to identify key features of the invention. Rather, it is to present some of the inventive concepts of this invention in a generalised form as a prelude to the detailed description that is to follow.

The present invention seeks to provide a system to counter or disable an undesirable unmanned aerial vehicle (UAV), of type class 1 UAS, which are driven by propellers.

Preferably, the system involves determining a distance and direction of an UAV, firing an airburst projectile and dispersing streamers into the flight path of the UAV, and disabling the propellers by entanglement with some of the streamers. This system makes use of an existing 40 mm grenade launcher and requires little or no re-training on its use. Advantageously, this is a non-destructive UAV counter system.

In one embodiment, the present invention provides an air-burst projectile for countering a target unmanned aerial vehicle (UAV) comprising: an ogive connected to a fuze assembly, which fuze assembly is then connected to a shell; wherein the ogive houses: a spinner, with the spinner having compartments in which a streamer, in a coiled up state, is disposed in each compartment; and the fuze assembly comprises a programmable fuze and an electric detonator; so that the spinner and the fuze assembly are located forward of the electric detonator, and when the UAV is determined to be a threat or undesirable, an airburst projectile is fired into a flight path of the UAV, such that when the ogive is burst open by activating the electric detonator, the spinner is ejected, causing the streamers to disperse and the streamers to open up from the coiled up state, thus creating a streamer cloud in the flight path of the UAV.

In another embodiment, the present invention provides a system for countering a target unmanned aerial vehicle (UAV) comprising: operating a laser range finder to determine a distance, speed and direction of the UAV; computing ballistic parameters for an airburst projectile to reach a flight path of the UAV; and firing a grenade launcher to propel the airburst projectile to the desired destination, and detonating the airburst projectile to disperse streamers to create a streamer cloud, so that some of the streamers may be caught by propellers of the UAV, thereby to disable the UAV and to bring the UAV to the ground.

In yet another embodiment, the present invention provides a system for countering a target UAV comprising: establishing or estimating a user distance to a territorial or air-exclusion boundary; entering the user distance into a programming unit (PU) on an associated grenade launcher; and after determining that the UAV is a threat or undesirable, firing the grenade launcher to propel an airburst projectile to the desired destination, and detonating the airburst projectile to create a streamer cloud as a warning shot or fence marking shot.

Preferably, the spinner comprises a rear annular plate being connected along an inner annular edge to a sleeve, and a plurality of partition plates extend radially from the sleeve and being in contact with a face of the rear annular plate, so that the space between adjacent radial partition plates form each compartment. A plurality of the spinners is stacked one on another along an axis that is substantially coaxial with a longitudinal axis of the airburst projectile. The plurality of spinners may be guided along a guide tube.

Preferably, the spinner further comprising a front annular plate, with an inner edge of the front annular plate being connected to a front end of the sleeve. The sleeve may have apertures, with each aperture in fluid communication with an associated compartment. The spinner may comprise a decelerator connected to an outer edge of each of the radial partition plate.

Preferably, the sleeve is elongate and forms a tube. Preferably, a plurality of streamers is packed in each compartment.

Preferably, the streamer is made from a web of material, which may be made from plastic, paper, fibres, fabric or a composite thereof. A streamer may be formed with a blob. The blob may be a bead or a knot.

BRIEF DESCRIPTION OF THE DRAWINGS

This invention will be described by way of non-limiting embodiments of the present invention, with reference to the accompanying drawings, in which.

DETAILED DESCRIPTION

Figure 1A:
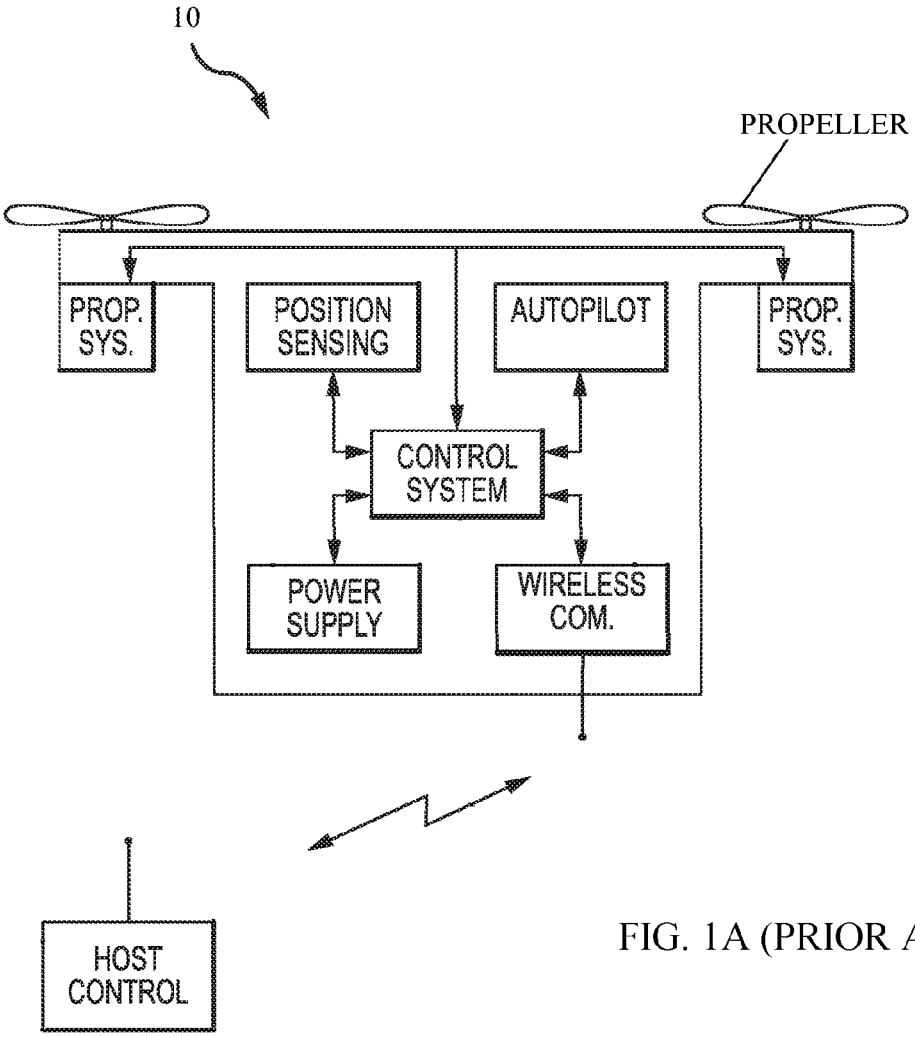
FIG. 1A (PRIOR ART)
FIG. 1A illustrates components of a typical drone.
Figure 1B:
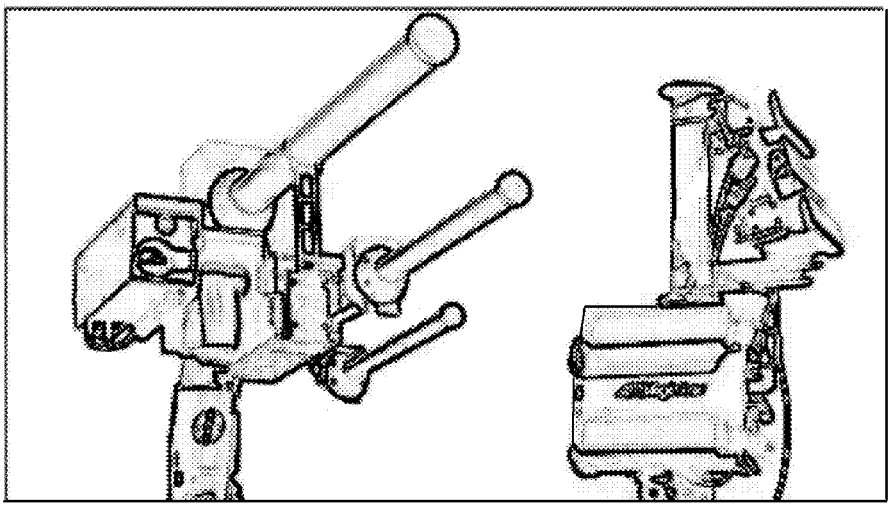
FIG. 1B (PRIOR ART)
FIGS. 1B-1G illustrate various known types of counter-UAV systems.
Figure 1C:
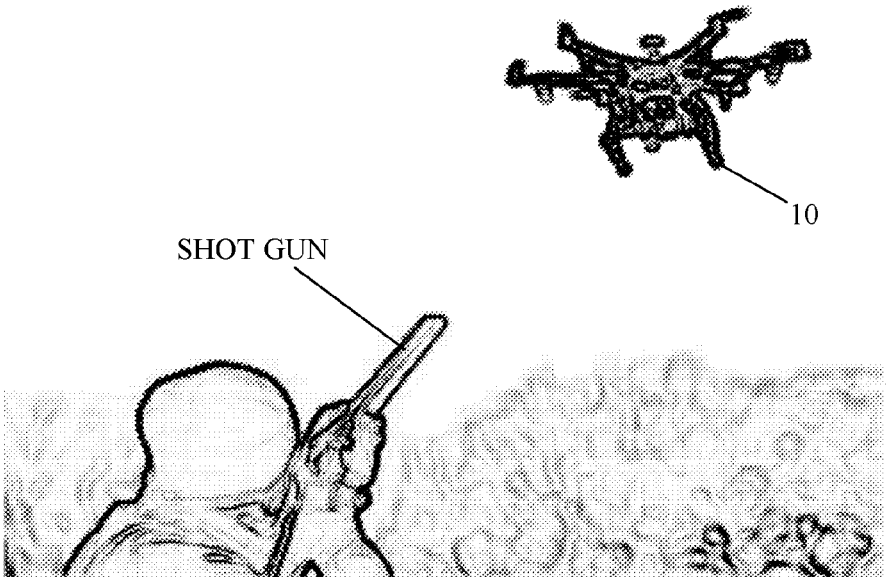
FIG. 1C (PRIOR ART)
Figure 1D:
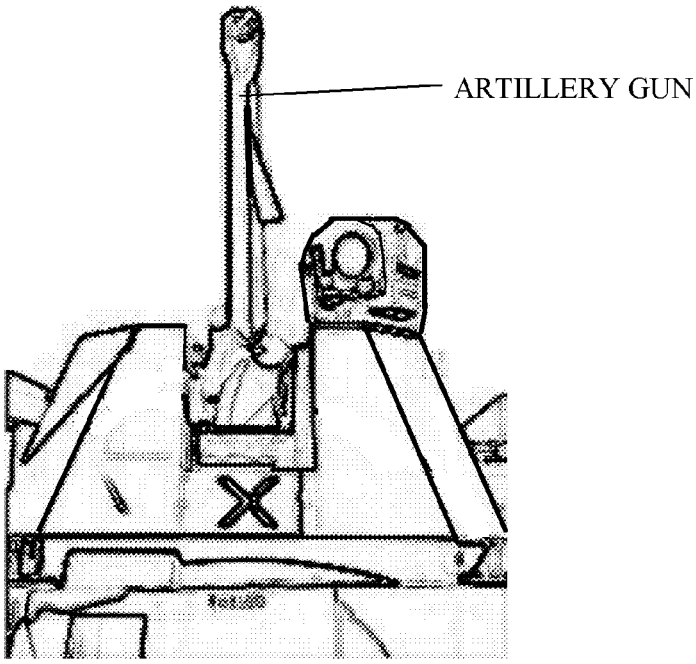
FIG. 1D (PRIOR ART)
Figure 1E:
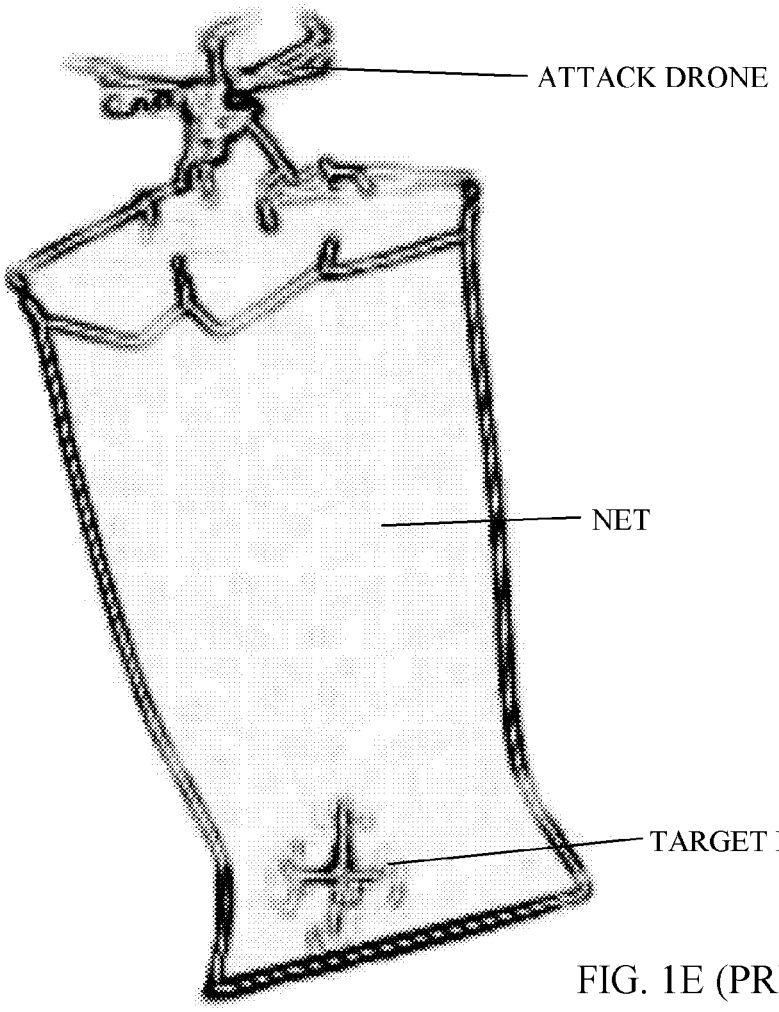
FIG. 1E (PRIOR ART)
Figure 1F:
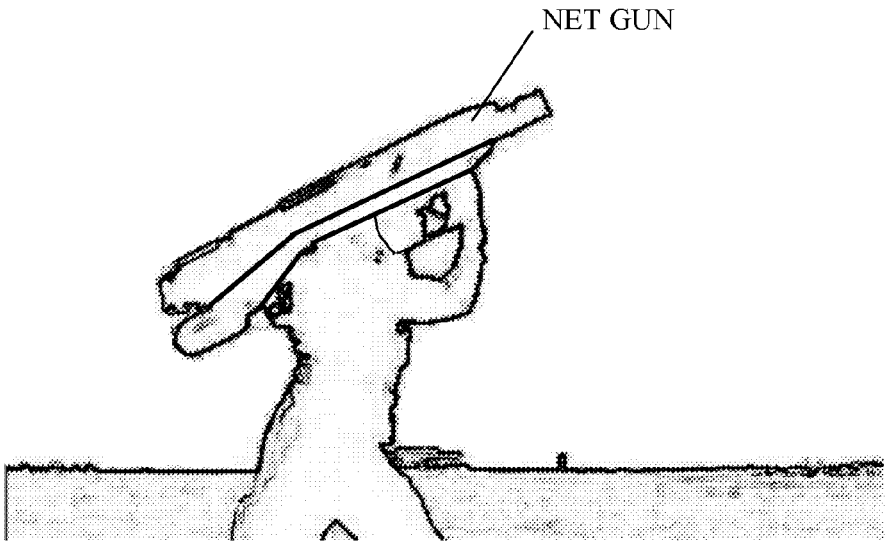
FIG. 1F (PRIOR ART)
Figure 1G:
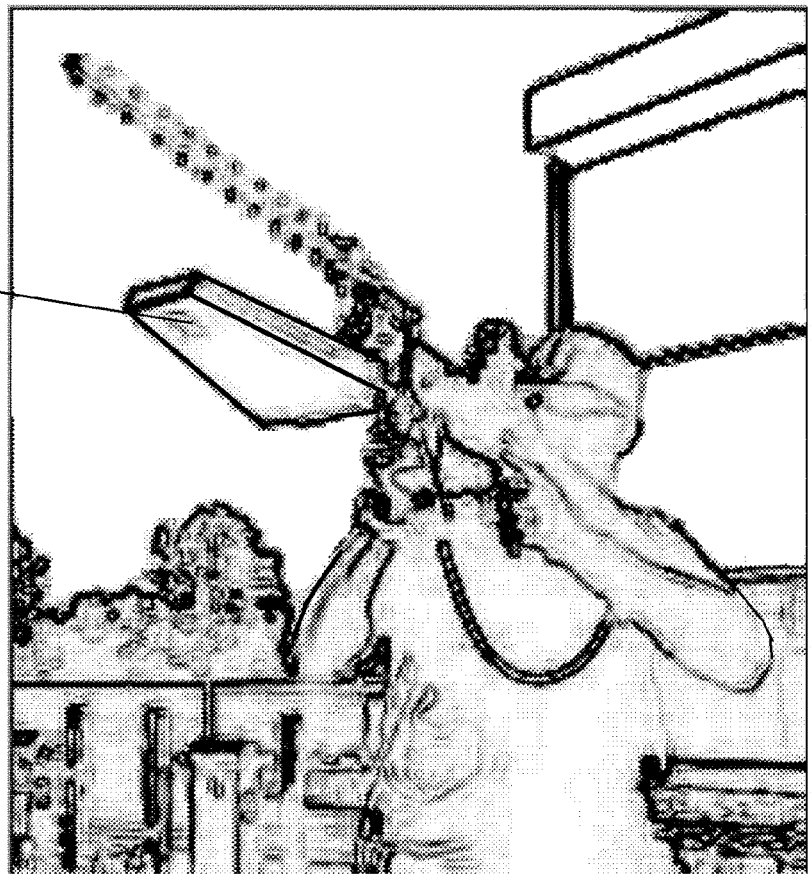
FIG. 1G (PRIOR ART)

One or more specific and alternative embodiments of the present invention will now be described with reference to the attached drawings. It shall be apparent to one skilled in the art, however, that this invention may be practised without such specific details. Some of the details may not be described at length so as not to obscure the invention. For ease of reference, common reference numerals or series of numerals will be used throughout the figures when referring to the same or similar features common to the figures.

Figure 2G:
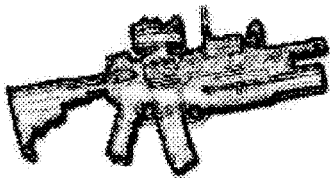
FIG. 2G (PRIOR ART)
FIG. 2G illustrates some known grenade launchers that can be used to launch the above grenades or airburst projectiles.
Figure 2G:
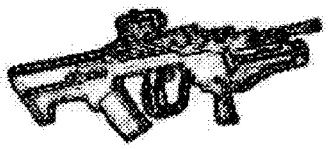
FIG. 2G (PRIOR ART)
Figure 2G:
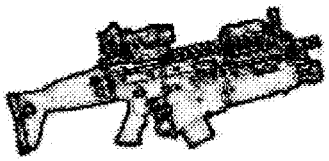
FIG. 2G (PRIOR ART)
Figure 2G:
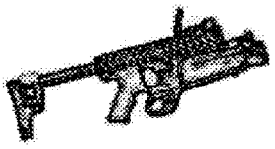
FIG. 2G (PRIOR ART)
Figure 2G:
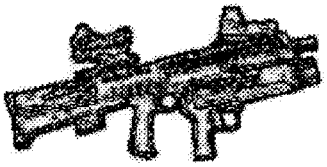
FIG. 2G (PRIOR ART)
Figure 2A:
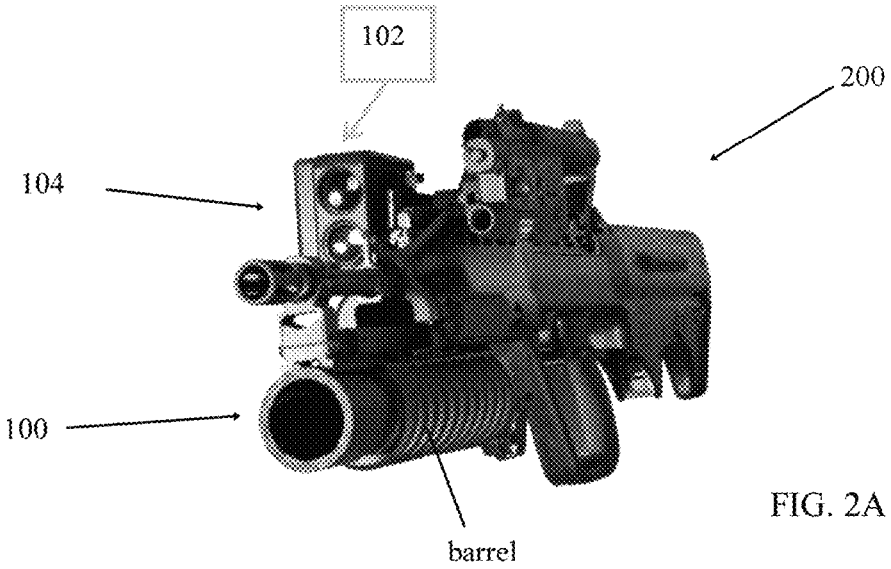
FIG. 2A illustrates a grenade launcher for launching an airburst projectile to disable a target UAV according to an embodiment of the present invention.
Figure 2B:
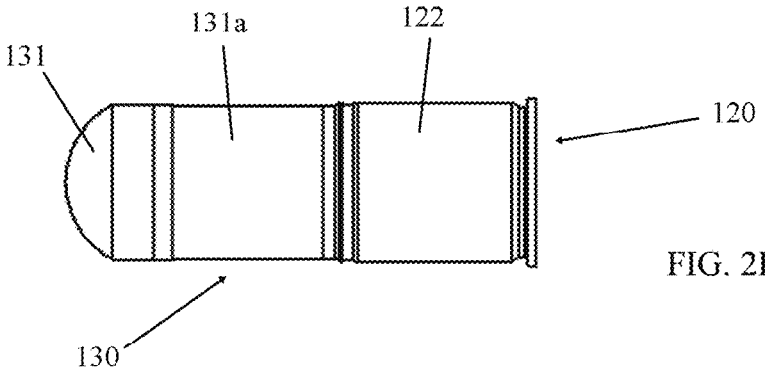
FIGS. 2B-2C illustrate an airburst projectile for use with the grenade launcher shown in FIG. 2A.
Figure 2C:
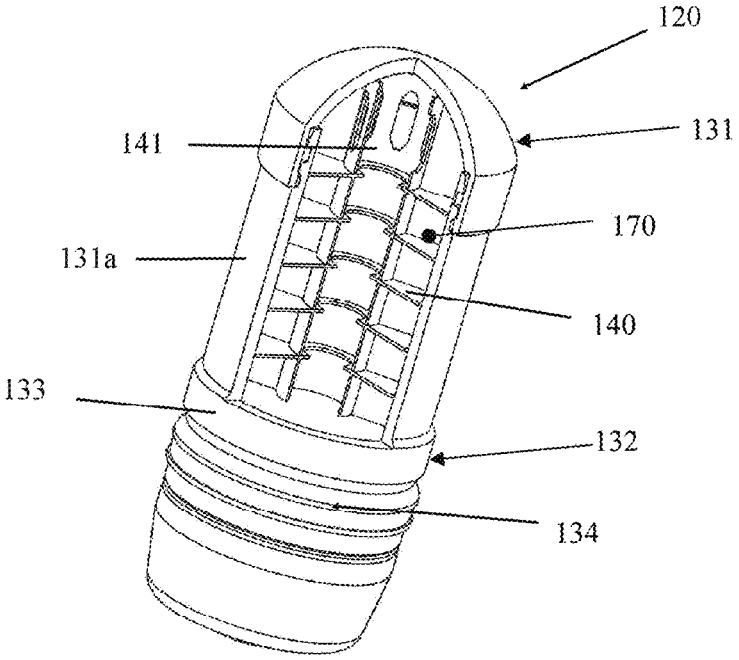
Figure 2D:
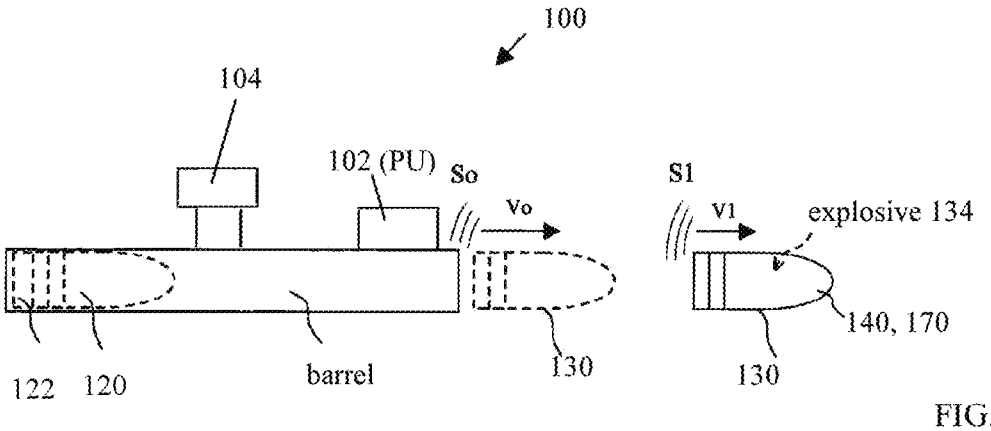
FIGS. 2D-2F illustrate schematic components of the above grenade launcher system.
Figure 2E:
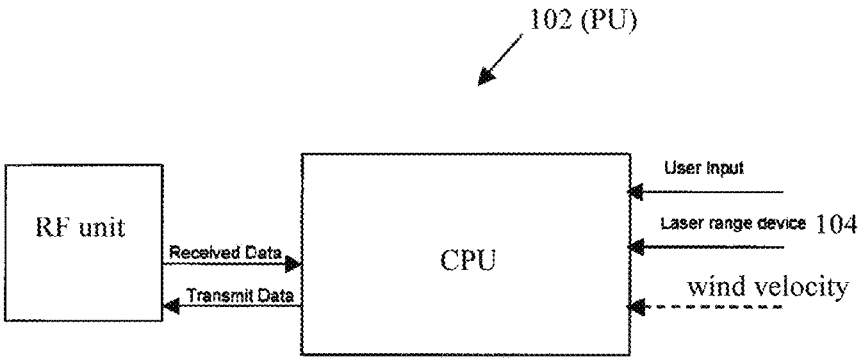
Figure 2F:
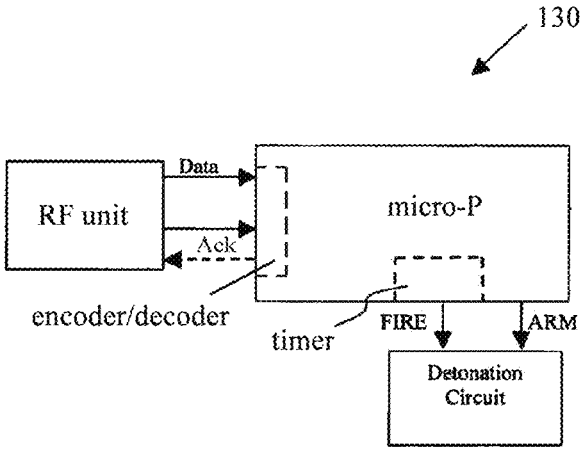
Figure 3:
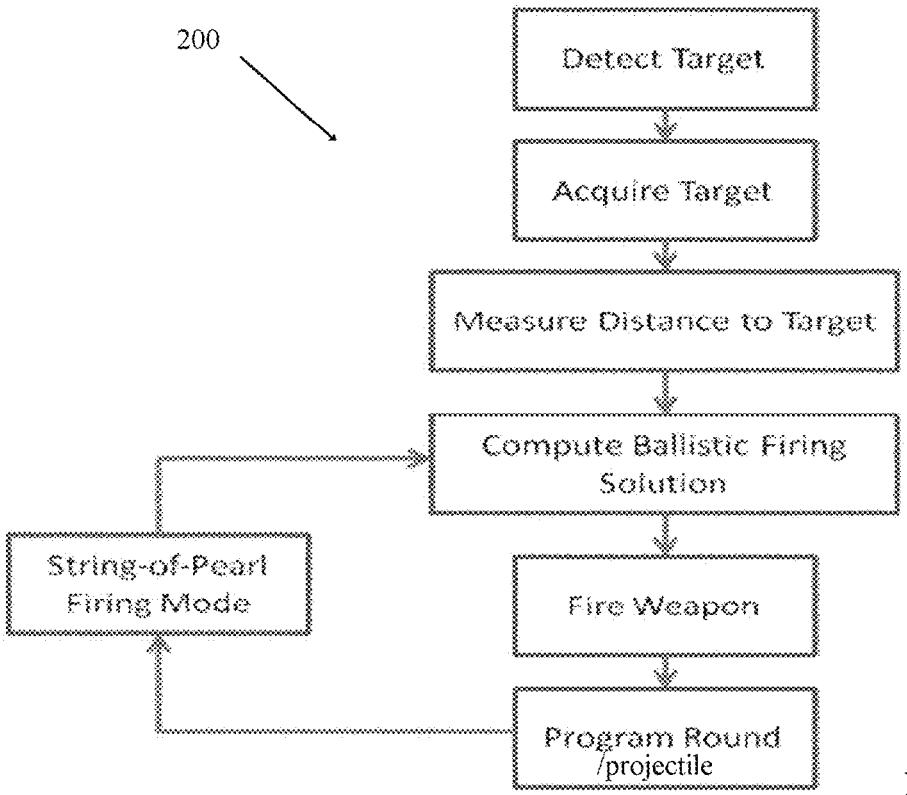
FIG. 3 illustrates a method of operating the above grenade launcher system.

FIG. 2A shows a grenade launcher 100 for launching a 40 mm grenade or airburst projectile 120 to counter a target unmanned aerial vehicle (UAV) 10; As seen in FIG. 2A, the grenade launcher 100 is underslung from a rifle. As shown, the grenade launcher 100 is equipped with a programming unit (PU) 102, with the PU 102 including a laser range finder 104. FIGS. 2B-2C show the grenade/airburst projectile 120, which is made up of a cartridge 122 containing a propellant 123 and a projectile 130. The projectile 130 has a shaped ogive 131 connected to a cylindrical portion 131*a*, with the cylindrical portion being connected to a fuze assembly 132; the fuze assembly 132 is in turn enclosed by a shell 133, which shell 133 may contain an explosive charge 134. Inside the shaped ogive 131 and the cylindrical portion 131*a* is a spinner 140 and a plurality of streamers 170. The spinner 140 forms compartments 150 and, preferably, a streamer 170 is located in each compartment, with each streamer 170 being coiled up into a compact pellet. These compartments and streamers will be described again with embodiments of the spinners 140.

Preferably, an electronic explosive device (EED) or electric ignitable device (EID) or electric detonator is activated to air burst the projectile 130 when the projectile has been ejected a predetermined distance away, is airborne and is safely armed. In another embodiment, the EED, EID or electronic detonator may be used to set off the explosive charge 134 disposed inside the shell 133; the required distance of dispersal of the streamers 170 determines use or amount of the explosive charge 134, or selection of the EED, EID or electric detonator.

In use, after a target UAV 10 is detected, a user fires the laser range finder 104 at the target UAV 10 to determine a distance, speed and direction of the target UAV with respect to the user. The distance, speed and direction of the target UAV 10 are inputted automatically into a CPU of the PU 102 and the ballistic firing parameters required of the grenade/airburst projectile 120 are calculated. When the user determines that the target UAV 10 is a threat or undesirable, a grenade/airburst projectile 120 is fired from the grenade launcher 100; when the projectile 130 is leaving the barrel of the grenade launcher 100, the PU 102 transmits the ballistic firing parameters into a micro-processor located inside the projectile 130, for eg. via radio frequency induction. The ballistic firing parameters include a delay firing time; after being propelled to a safe distance away from the user and the delay firing time has expired, a firing circuit located inside the projectile 130 activates the electric detonator, EED or EID, which may then set off the explosive charge 134 and cause the shaped ogive 131 to disconnect from its cylindrical portion 131*a*; as a result, the spinner 140 is expelled from the projectile 130. After being separated from the projectile, the spinner 140 slows down in both trajectory and spin speeds, and as a result, the streamers 170 are dispersed out from spinner 140; the streamers 170 also slow down in speed but they open up (from the coiled-up state) to create a streamer cloud in a flight path of the target UAV 10. As a result, some of the streamers 170 become entangled with the propeller blades of the target UAV 10, so that the target UAV becomes disabled and fall to the ground. This counter grenade launching system 200 is shown in FIGS. 2A, 2D-2F and 3.

In another use, a user may not utilize a laser range finder but knows, or can estimate, user distance to a territorial boundary or air-exclusion zone. In response to an undesirable UAV 10, a user inputs the known/estimate distance into the PU 102 on the grenade launcher 100 and then launches a projectile 130 to disperse a streamer cloud near the territorial boundary or air-exclusion zone as a warning shot or fence marking shot. In this application, a delay time for activating the electric detonator, EED or EID is entered into a PU 102, which then programs the delay time into the projectile 130 as the projectile is propelled out off a barrel of the grenade launcher 100.

An advantage of this UAV counter system 200 is that the 40 mm grenade launcher 100 may be an existing asset and no additional capital expense is required for the hardware; in addition, a user may be familiar with the use of the 40 mm grenade system and no additional training is also required. Another advantage is the non-destructive nature of this UAV counter system 200. FIG. 2G shows some known grenade launchers that can be used to launch the above grenades/airburst projectiles 130.

Figure 4A:
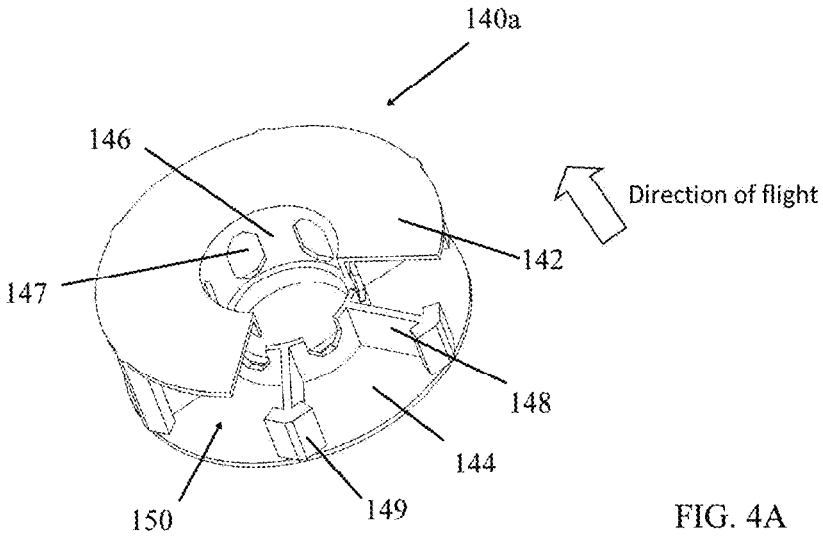
FIGS. 4A-4D illustrate embodiments of spinners disposed in the airburst projectile.

FIG. 4A shows a spinner 140*a* according to an embodiment. In use, a number of the spinners 140*a* are stacked one on another in a longitudinal row inside the grenade/airburst projectile 120. Each spinner 140*a* is like a wheel hub with an annular front plate 142, an annular rear plate 144 and a sleeve 146, with the sleeve 146 connecting the front and rear annular plates along the inner annular edges. Radially extending from the sleeve 146 are a plurality of partition plates 148. The end of each partition plate 148 is capped with a decelerator 149. As seen from FIG. 4A, the space bound by the front plate, rear plate and sleeve is divided into compartments 150 by the partition plates 148. The sleeve 146 has apertures 147 so that each aperture 147 is in fluid communication with an associated compartment 150. Preferably, a streamer 170 (packed by being coiled up into a pellet or compact form) is disposed in each compartment 150. It is also possible that a number of pellets of the streamers 170 are disposed in each compartment 150 depending on the construction of the streamers and size of the compartments. When the spinner 140*a* is dispersed and moving in trajectory, streams of air are forced to flow through the apertures 147 into the associated compartments 150; however, the decelerators 149 are provided to temporarily slow down outward discharge of the pellets of streamers 170 and, thus, slow down the speed of centrifugal discharge to create a streamer cloud.

Figure 4B:
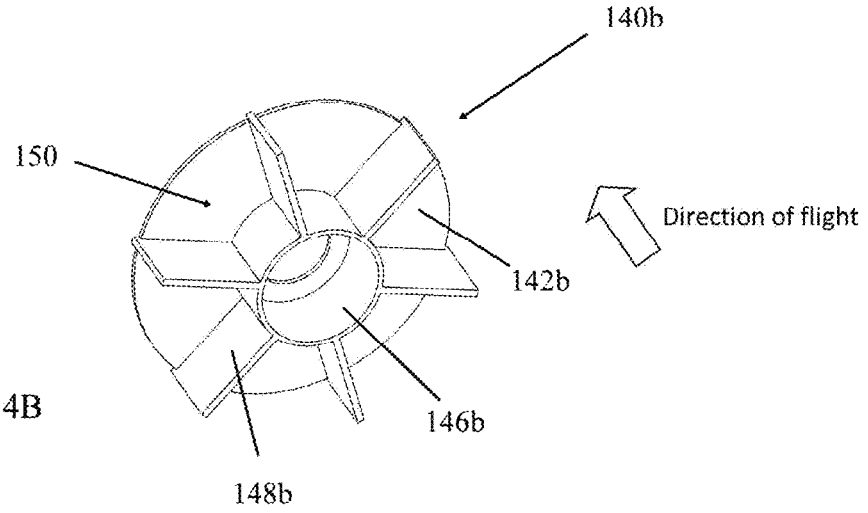

FIG. 4B shows a spinner 140*b* according to another embodiment. The spinner 140*b* is similar to the above spinner 140*a* except that there is no rear annular plate and no apertures. In use, the spinners 140*b* are stacked one over another along a longitudinal axis inside the projectile 130. In another embodiment, these spinners 140*a* are stacked one over another along a guide tube 141 (as can be visualised in FIG. 2C). After the ogive 131 has been disconnected from the cylindrical portion 131*a*, the spinners 140*b* are ejected and they continue to spin and travel in trajectories. The forces of rotation of the spinner 140*b* disperse the streamers 170 from the respective compartments 150, and as a result of motion through the air, the streamers 170 open up (from the coiled-up state) to create a streamer cloud in the flight path of the target UAV 10.

Figure 4C:
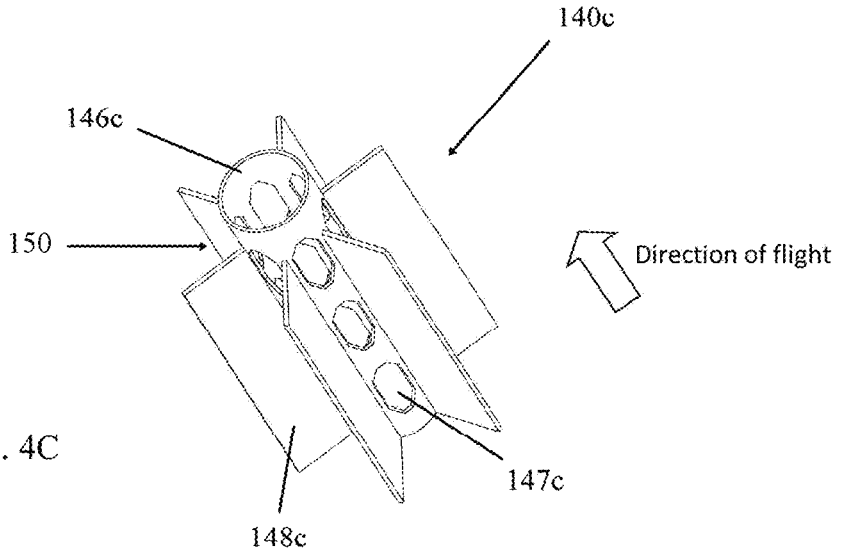

FIG. 4C shows a spinner 140*c* according to another embodiment. In use, the spinners 140*c* are also stacked one on another in a longitudinal row. Each spinner 140*c* is made up of a hollow tube or sleeve 146*c* with radial partition plates 148*c* disposed along the tube/sleeve 146*c*. The radial partition plates 148*c* thus form radial compartments 150 around the tube/sleeve 146*c*. In another embodiment, apertures 147*c* are formed along the wall of the tube/sleeve 146*c* so that a row of apertures 147*c* are in fluid communication with an associated radial compartment 150.

Figure 4D:
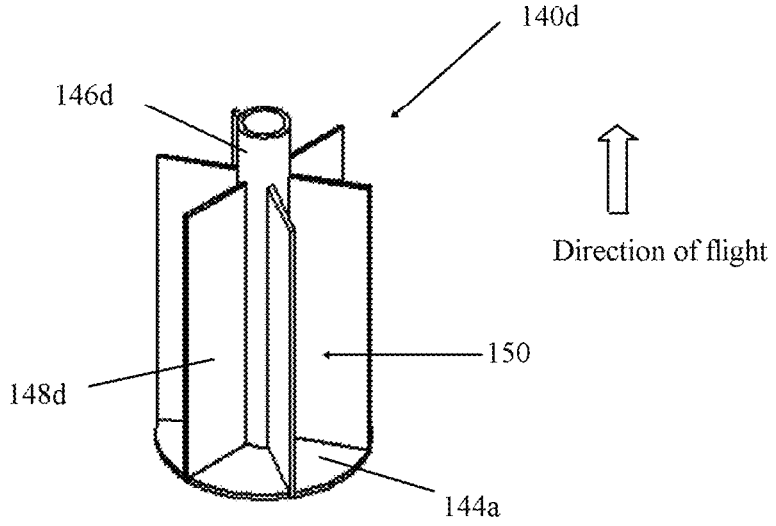

FIG. 4D shows a spinner 140*d* according to yet another embodiment. The spinner 140*d* is made up of a hollow tube 146*d* with radial partition plates 148*d* disposed along a periphery of tube 146*d* and a rear annular plate 144*a*. The radially extending partition plates 148*d* thus form radial compartments 150 around the tube 146*d*. With this embodiment, in use, a row of streamers 170 are packed along each compartment 150 and the rear annular plate 144*a* helps to effectively disperse the streamers 170 to form a streamer cloud, without need to form apertures along the tube 146*d*.

Figure 4E:
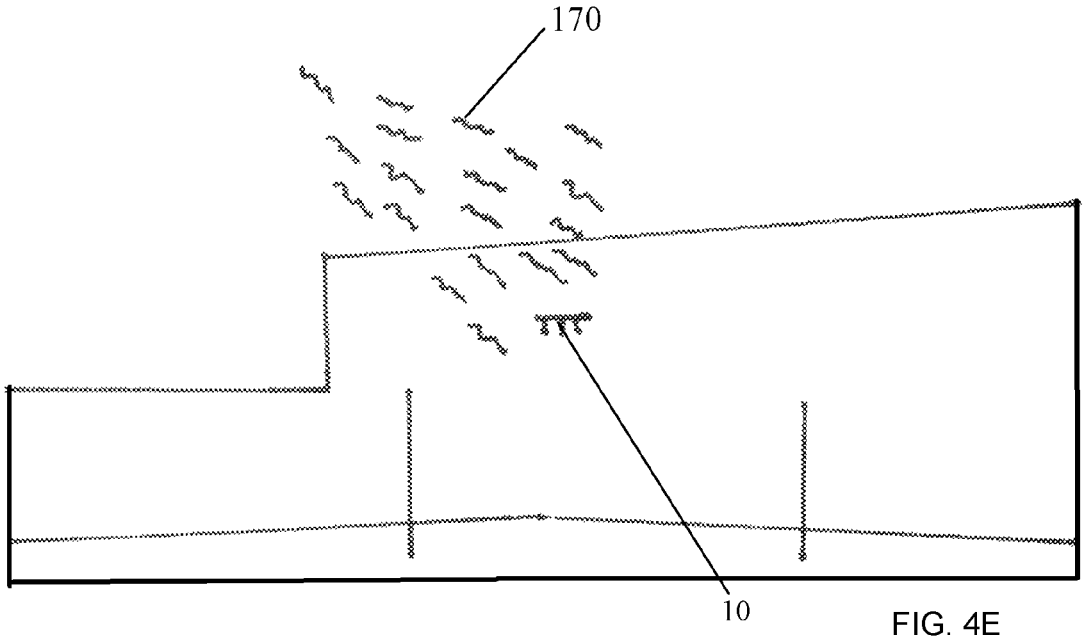
FIGS. 4E-4G illustrate dispersion of streamers into a flight path of a target UAV.

As described above, in use, after being dispersed, the streamers 170 open up and create a streamer cloud in the flight path of a target UAV 10. FIG. 4E shows a picture taken during testing of the above airburst projectile 120, 130 and streamers 170.

Figure 4F:
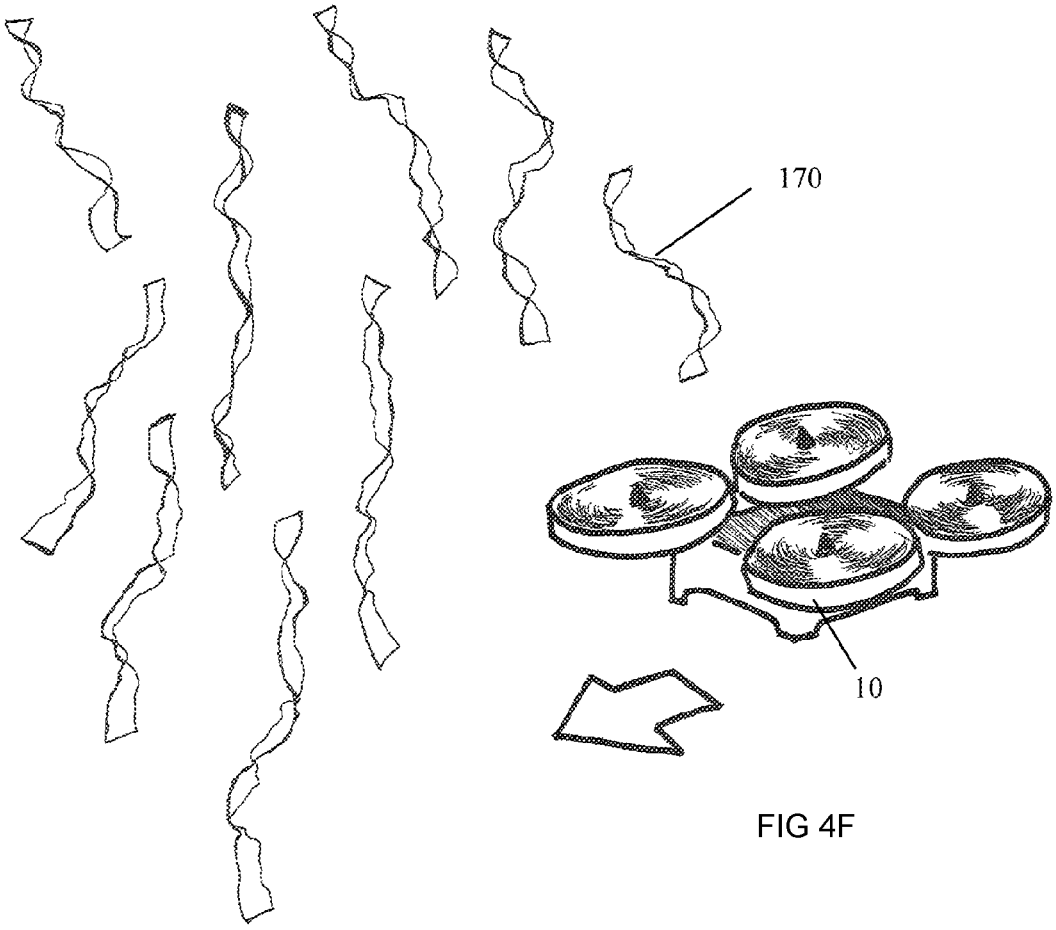

In one embodiment, the streamers 170 are made from webs of materials that are relatively long compared to a width dimension. For illustration, the streamers may have a length of about 30-400 cm, may have a width of about 5-15 mm and a thickness of about 0.01-0.2 mm, preferably about 0.02-0.05 mm. The streamers 170 may be made from a plastic material, paper, fabric, fibres, and so on. Preferably, the paper is waxed, laminated or coated to provide some water resistance to allow the streamers to be deployed in a wet or snowy environment. The fabrics or fibres can be natural and/or synthetic, or a composite. These streamers 170 are very light in weight and they experience large drag forces when dispersed in the air, so that the streamers settle very slowly under gravity. Dispersion of the streamers 170 is also illustrated in FIG. 4F.

Figure 4G:
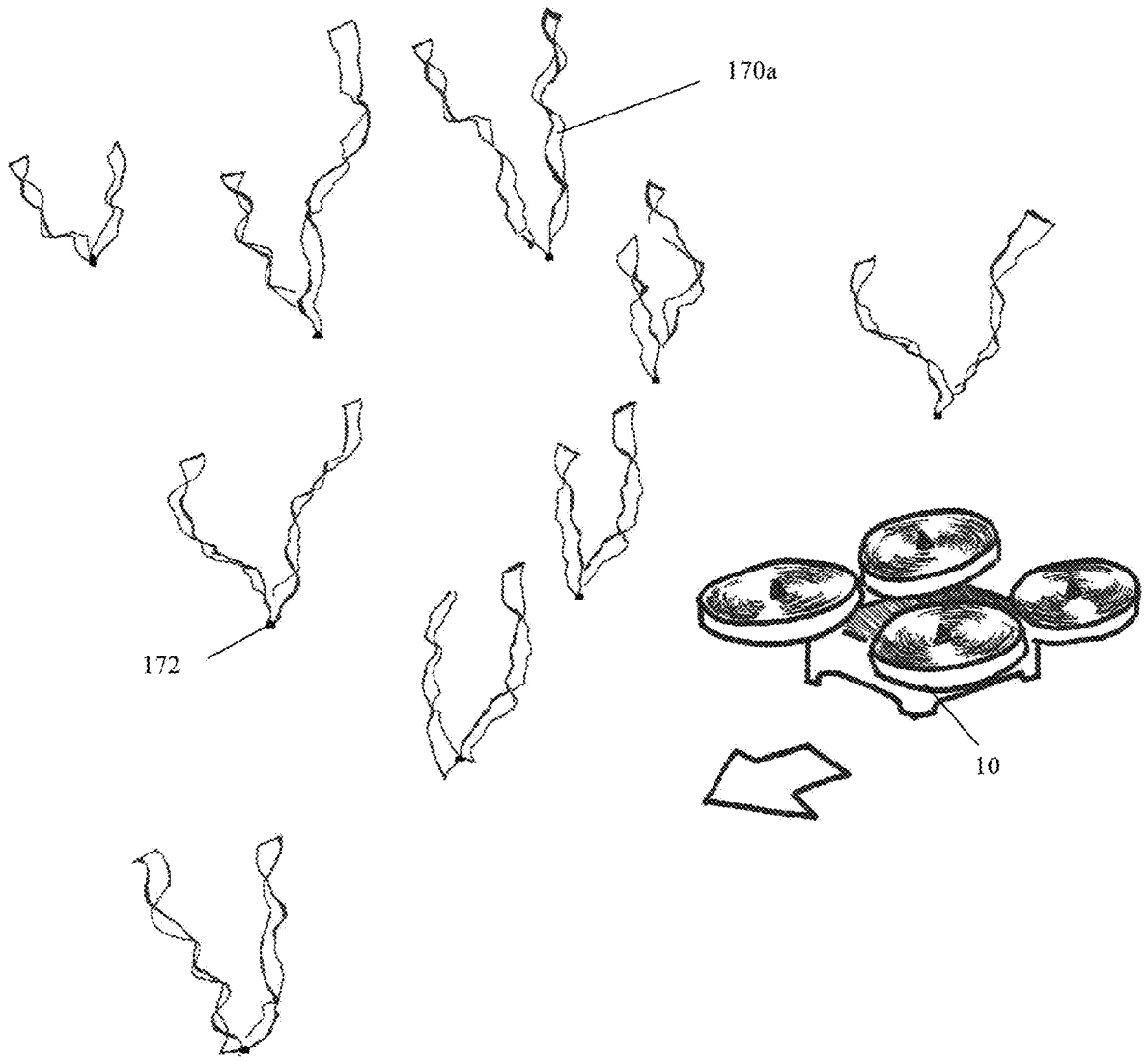

In FIG. 4G, each streamer 170*a* is shown to have a blob 172 located at an intermediate position between the two free ends. The blob 172 may be formed by forming two or more loops of the web material and tying up the loops in a knot. Alternatively, a bead may be attached with an adhesive to each web; alternatively, a streamer 170*a* is formed by threading the web material through a hole in the bead. As seen in FIG. 4G, the centre of mass is located at the blob 172; the blobs 172 thus assist the streamers 170*a* to disperse upon ejection from the airburst projectile 130.

While specific embodiments have been described and illustrated, it is understood that many changes, modifications, variations and combinations thereof could be made to the present invention without departing from the scope of the invention. For eg., the above invention may incorporate Applicant's own invention published in U.S. Pat. No. 8,393,539 on the inflight programming of the firing time into an airburst projectile. In addition, the free end of each streamer 170, 170*a* may be formed with a hook or spiral to facilitate more effective entanglement with propeller blades of the target UAV 10.

The invention claimed is:

1. An airburst projectile for countering an unmanned aerial vehicle (UAV) comprising:

an ogive connected to a fuze assembly, which fuze assembly is then connected to a shell;

wherein the ogive houses:

a spinner, wherein the spinner comprises a rear annular plate being connected along an inner annular edge to a sleeve, and a plurality of partition plates extend radially from the sleeve and being in contact with a face of the rear annular plate, so that a space between adjacent radial partition plates form each compartment and a streamer, in a coiled-up state, is disposed in each compartment; and the fuze assembly comprises a programmable fuze and an electric detonator;

so that the spinner and the fuze assembly are located forward of the electric detonator, and when an UAV is determined to be a threat or undesirable, an airburst projectile is fired into a flight path of the UAV, such that when the ogive is burst open by activating the electric detonator, the spinner is ejected, causing the streamers to disperse and the streamers to open up from the coiled-up state, thus creating a streamer cloud in the flight path of the UAV.

2. The airburst projectile according to claim 1, wherein a plurality of the spinners is stacked one on another along an axis that is substantially coaxial with a longitudinal axis of the airburst projectile.

3. The airburst projectile according to claim 2, further comprising a guide tube, along which the plurality of spinners is stacked one on another.

4. The airburst projectile according to claim 1, further comprising a front annular plate, with an inner edge of the front annular plate being connected to a front end of the sleeve.

5. The airburst projectile according to claim 1, wherein the sleeve has apertures, with each aperture in fluid communication with an associated compartment.

6. The airburst projectile according to claim 1, further comprising a decelerator connected to an outer edge of each of the radial partition plate.

7. The airburst projectile according to claim 1, wherein the sleeve is elongate and forms a tube.

8. The airburst projectile according to claim 7, wherein the tube comprises a plurality of apertures, so that a row of apertures along the tube is in fluid communication with an associated compartment.

9. The airburst projectile according to claim 7, wherein a plurality of streamers is packed in each compartment.

10. The airburst projectile according to claim 1, wherein each streamer has a blob formed at an intermediate location between two free ends.

11. The airburst projectile according to claim 10, wherein the blob is a bead.

12. The airburst projectile according to claim 10, wherein the blob is knot of the web material.

13. A method for countering an unmanned aerial vehicle (UAV) comprising:

operating a laser range finder to determine a distance, speed and direction of the UAV;

establishing or estimating a user distance to a territorial or air-exclusion boundary;

entering a user distance to the territorial or air-exclusion boundary into a programming unit (PU) on an associated grenade launcher;

computing ballistic parameters for an airburst projectile to reach a flight path of the UAV; and after determining that the UAV is a threat or undesirable, firing the grenade launcher to propel the airburst projectile to the desired destination, and detonating the airburst projectile to disperse streamers to create a streamer cloud as a warning shot or detonating a series of the airburst projectiles for fence marking along a relevant part of a territorial or air-exclusion boundary.

* * * * *